US009240142B2

(12) United States Patent
Oh et al.

(10) Patent No.: US 9,240,142 B2
(45) Date of Patent: Jan. 19, 2016

(54) APPARATUS AND METHOD FOR DRIVING ORGANIC LIGHT EMITTING DISPLAY DEVICE

(71) Applicant: LG DISPLAY CO., LTD., Seoul (KR)

(72) Inventors: Jinyoung Oh, Paju-si (KR); JaeHyeong Jeong, Paju-si (KR); HyunKi Lee, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 405 days.

(21) Appl. No.: 13/713,705

(22) Filed: Dec. 13, 2012

(65) Prior Publication Data

US 2014/0104259 A1 Apr. 17, 2014

(30) Foreign Application Priority Data

Oct. 15, 2012 (KR) ..... 10-2012-0114039

(51) Int. Cl.
*G09G 3/32* (2006.01)

(52) U.S. Cl.
CPC ..... *G09G 3/3266* (2013.01); *G09G 3/3233* (2013.01); *G09G 3/3275* (2013.01); *G09G 2320/041* (2013.01); *G09G 2330/025* (2013.01); *G09G 2340/16* (2013.01); *G09G 2360/16* (2013.01)

(58) Field of Classification Search
CPC ..... G09G 2320/041
See application file for complete search history.

(56) References Cited

U.S. PATENT DOCUMENTS

| | | | | |
|---|---|---|---|---|
| 2008/0284493 | A1 | 11/2008 | Baek et al. | |
| 2010/0007680 | A1* | 1/2010 | Yu et al. | 345/690 |
| 2011/0205442 | A1* | 8/2011 | Mori et al. | 348/673 |
| 2011/0227966 | A1 | 9/2011 | Mori | |

FOREIGN PATENT DOCUMENTS

| | | | |
|---|---|---|---|
| CN | 1949943 | A | 4/2007 |
| CN | 101373389 | A | 2/2009 |
| CN | 101625825 | A | 1/2010 |
| CN | 102292757 | A | 12/2011 |
| KR | 1020090080269 | A | 7/2009 |
| KR | 1020110076652 | A | 7/2011 |

OTHER PUBLICATIONS

Office Action dated Jun. 19, 2015 for corresponding Chinese Application No. 201210574413.1, 20 pages.

* cited by examiner

*Primary Examiner* — Kathy Wang-Hurst
*Assistant Examiner* — Peijie Shen
(74) *Attorney, Agent, or Firm* — Brinks Gilson & Lione

(57) ABSTRACT

Disclosed is an apparatus and method for driving an organic light emitting display device which facilitates to control current consumption of a display panel according to a temperature of the display panel including a light emitting device or a surrounding temperature of the display panel, the apparatus comprising the display panel including the plurality of pixels provided with the plurality of light emitting devices which emit light according to a current, a temperature sensing unit for generating temperature data by sensing a temperature of the display panel or surrounding temperature; and a panel driver for controlling a data signal to be supplied to each pixel so as to make current consumption of the display panel be lower than a preset current limit value on the basis of input data and temperature data.

20 Claims, 11 Drawing Sheets

APPARATUS AND METHOD FOR DRIVING ORGANIC LIGHT EMITTING DISPLAY DEVICE

CROSS REFERENCE TO RELATED APPLICATIONS

This application claims the benefit of the Korean Patent Application No. 10-2012-0114039 filed on Oct. 15, 2012, which is hereby incorporated by reference as if fully set forth herein.

BACKGROUND

1. Field of the Disclosure

The present disclosure relates to an organic light emitting display device, and more particularly, to an apparatus and method for driving an organic light emitting display device which facilitates to control current consumption of a display panel according to a temperature of the display panel including a light emitting device or a surrounding temperature of the display panel.

2. Discussion of the Related Art

Due to recent multimedia developments, there is an increasing demand for a flat panel display. In order to satisfy this increasing demand, various flat panel displays such as liquid crystal display, plasma display panel, field emission display and organic light emitting display are practically used. Among the various flat panel displays, the organic light emitting display device has been attracted as a next-generation flat panel display owing to advantages of rapid response speed and low power consumption. In addition, the organic light emitting display device can emit light in itself, whereby the organic light emitting display device does not cause a problem related with a narrow viewing angle.

Generally, the organic light emitting display device displays an image by applying a data signal to each pixel, and controlling a current flowing in an organic light emitting device according to a data current corresponding to the data signal. For this, each pixel includes the organic light emitting device, a switching transistor, a driving transistor, and at least one capacitor.

An amount of light emitted from the organic light emitting device is proportional to a current amount supplied from the driving transistor. The switching transistor is switched according to a scanning signal, whereby the switching transistor supplies the data signal supplied from a data line to the driving transistor. The driving transistor is switched according to the data signal supplied from the switching transistor, whereby the driving transistor generates the data current based on the data signal, and supplies the generated data current to the organic light emitting device. The capacitor maintains the data signal supplied to the driving transistor for 1 frame period.

However, in case of the organic light emitting display device according to the related art, current consumption is changed according to a surrounding (or environmental) temperature and/or a temperature of a display panel. That is, as shown in FIG. 1, the current consumption of the organic light emitting display device according to the related art is increased in proportion to the temperature.

Accordingly, in the organic light emitting display device according to the related art, if the current consumption of the display panel is excessively increased by an image of each frame unit, a power supplier may be shut-down due to overcurrent, thereby deteriorating reliability of device (or product). Further, even though data of the same luminance is displayed on the display panel in the organic light emitting display device according to the related art, the current consumption is changed according to the temperature, to thereby shorten lifespan of the organic light emitting device.

SUMMARY

An apparatus for driving an organic light emitting display device comprises: a display panel including a plurality of pixels provided with a plurality of light emitting devices which emit light according to a current; a temperature sensing unit that generates temperature data by sensing a temperature of the display panel or surrounding temperature; and a panel driver that controls a data signal to be supplied to each pixel so as to make current consumption of the display panel be lower than a preset current limit value on the basis of input data and temperature data.

In another aspect of the present invention, there is provided a method for driving an organic light emitting display device comprising a display panel for displaying an image by making a light emitting device in each of pixels emit light by the use of current, comprising: generating temperature data by sensing a temperature of the display panel or surrounding temperature; and controlling a data signal to be supplied to each pixel so as to make current consumption of the display panel be lower than a preset current limit value on the basis of input data and the temperature data.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE EXEMPLARY EMBODIMENTS

Reference will now be made in detail to the exemplary embodiments of the present invention, examples of which are illustrated in the accompanying drawings. Wherever possible, the same reference numbers will be used throughout the drawings to refer to the same or like parts.

Hereinafter, an apparatus and method for driving an organic light emitting display device according to the present invention will be described with reference to the accompanying drawings.

Figure 1:
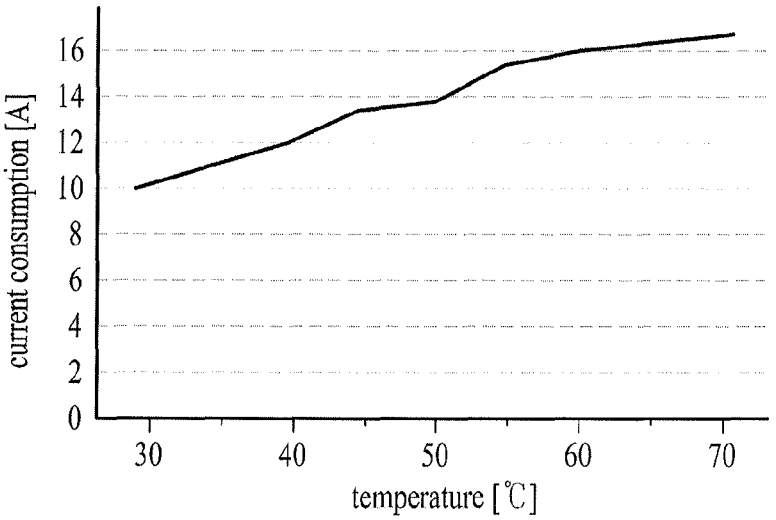
FIG. 1 Related Art
FIG. 1 is a graph illustrating current consumption according to a temperature of an organic light emitting display device according to the related art.
Figure 2:
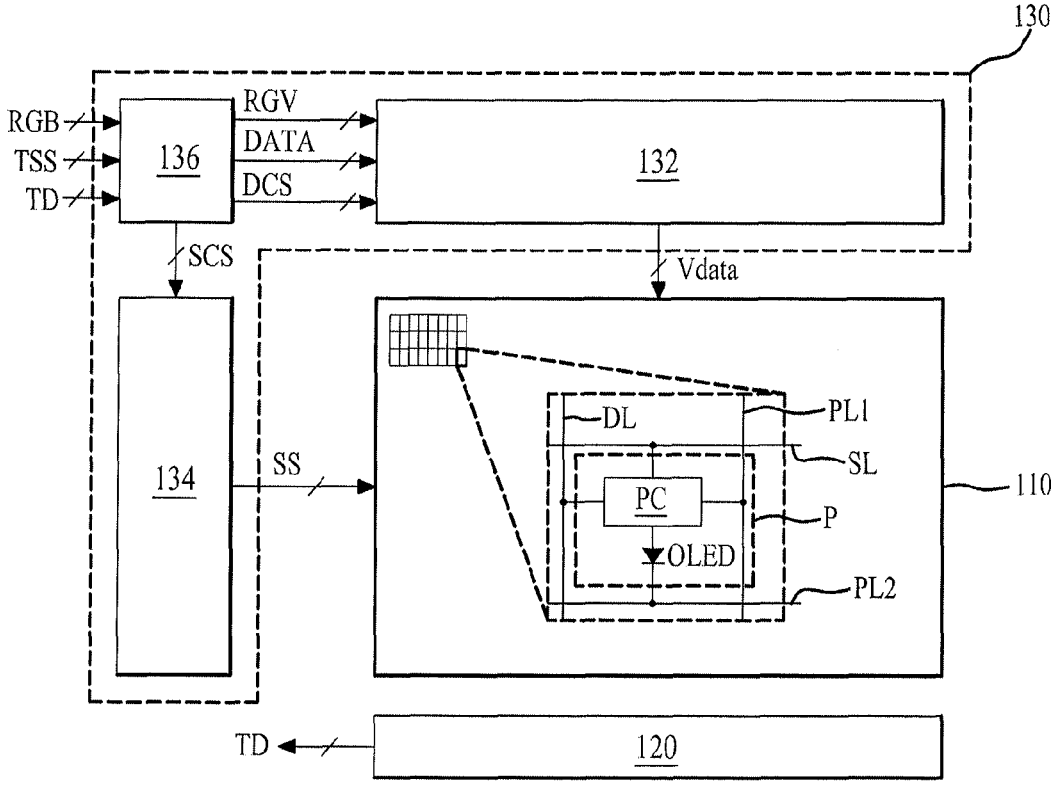
FIG. 2 illustrates an apparatus for driving an organic light emitting display device according to the embodiment of the present invention.

FIG. 2 illustrates an apparatus for driving an organic light emitting display device according to the embodiment of the present invention.

Referring to FIG. 2, an apparatus for driving an organic light emitting display device according to the embodiment of the present invention includes a display panel 110, a temperature sensing unit 120, and a panel driver 130. The display panel 110 comprises a plurality of pixels (P) including a plurality of organic light emitting devices (OLED) which emit light by a current corresponding to a data signal (Vdata). The temperature sensing unit 120 generates temperature data (TD) by sensing a temperature of the display panel 110 or a surrounding temperature. The panel driver 130 controls the data signal (Vdata) to be supplied to each pixel (P) so as to make current consumption of the display panel 110 be lower than a preset current limit value on the basis of input data (RGB) and temperature data (TD).

In the display panel 110, the organic light emitting device (OLED) for each pixel (P) emits light according to the data signal (Vdata) supplied from the panel driver 130, whereby a predetermined color image is displayed through the use of light emitted from each pixel (P). For this, the display panel 110 includes a plurality of data lines (DL) and scanning lines (SL) crossing each other to define respective pixel regions; a plurality of first driving power source lines (PL1) provided in parallel to the plurality of data lines (DL); and a plurality of second driving power source lines (PL2) provided in perpendicular to the plurality of first driving power source lines (PL1).

The plurality of data lines (DL) are formed at fixed intervals in a first direction, and the plurality of scanning lines (SL) are formed at fixed intervals in a second direction being in perpendicular to the first direction. The first driving power source line (PL1) is formed in parallel to each of the data lines (DL) while being adjacent to each of the data lines (DL), whereby an externally-provided first driving power is supplied to the first driving power source line (PL1).

Each of the second driving power source lines (PL2) is formed in perpendicular to each of the first driving power source lines (PL1), whereby an externally-provided second driving power is supplied to the second driving power source line (PL2). In this case, a voltage level of the second driving power may be lower than that of the first driving power, or the second driving power may have a ground voltage level.

Meanwhile, the display panel 110 may include a common electrode instead of the plurality of second driving power source lines (PL2). In this case, the common electrode may be formed on an entire display area of the display panel 110, whereby the externally-provided second driving power may be supplied to the common electrode.

Each of the pixels (P) may be formed of any one color among red, green, blue and white colors. Accordingly, a unit pixel for displaying a color image by the plurality of pixels (P) may comprise the neighboring red pixel, green pixel and blue pixel, or may comprise the neighboring red pixel, green pixel, blue pixel and white pixel. Meanwhile, the unit pixel may comprise red, green, sky blue and deep blue colors. Eventually, the plurality of pixels (P) may comprise various colors of red, green, white, sky blue, deep blue, yellow and bluish green colors, and the unit pixel may comprise at least three pixels of different colors.

Each of the pixels (P) may include the organic light emitting device (OLED) and a pixel circuit (PC).

The organic light emitting device (OLED) is connected between the pixel circuit (PC) and the second driving power source line (PL2), wherein the organic light emitting device (OLED) emits light in proportion to an amount of data current supplied from the pixel circuit (PC), to thereby emit a predetermined color light. For this, the organic light emitting device (OLED) includes an anode electrode (or pixel electrode) connected with the pixel circuit (PC); a cathode electrode (or reflective electrode) connected with the second driving power source line (PL2); and an organic light emitting cell for emitting any one color among red, green, blue and white colors, wherein the organic light emitting cell is formed between the anode electrode and the cathode electrode. In this case, the organic light emitting cell may be formed in a deposition structure of hole transport layer/organic light emitting layer/electron transport layer, or a deposition structure of hole injection layer/hole transport layer/organic light emitting layer/electron transport layer/electron injection layer. Further, the organic light emitting cell may be additionally provided with a functional layer for improving light-emitting efficiency and/or lifespan of the organic light emitting device (OLED).

In response to a scanning signal (SS) supplied from the panel driver 130 to the scanning line (SL), the pixel circuit (PC) makes the data current flow in the organic light emitting device (OLED), wherein the data current corresponds to the data signal (Vdata) supplied from the panel driver 130 to the data line (DL). For this, the pixel circuit (PC) includes at least one capacitor, a driving transistor, and a switching transistor formed on a substrate during a process for forming a thin film transistor.

The switching transistor is switched according to the scanning signal (SS) supplied to the scanning line (SL), whereby the data signal (Vdata) supplied from the data line (DL) is supplied to the driving transistor. The driving transistor is switched according to the data signal (Vdata) supplied from the switching transistor, whereby the switched driving transistor generates the data current based on the data signal (Vdata), and supplies the generated data current to the organic light emitting device (OLED), to thereby make the organic light emitting device (OLED) emit light in proportion to the amount of data current. Also, at least one capacitor maintains the data signal (Vdata) supplied to the driving transistor for 1 frame period.

In the pixel circuit (PC) for each pixel (P), there is a deviation of a threshold voltage of the driving transistor according to driving time of the driving transistor, whereby picture quality might be deteriorated. Accordingly, the organic light emitting display device according to the present invention may further include a compensation circuit for compensating the threshold voltage of the driving transistor.

The compensation circuit may be formed by an internal compensation method for compensating the threshold voltage of the driving transistor inside the pixel circuit (PC), or an external compensation method for compensating the threshold voltage of the driving transistor in the panel driver 130.

The compensation circuit of the internal compensation method is provided with at least one compensation transistor and at least one compensation capacitor inside the pixel circuit (PC). The compensation circuit of the internal compensation method compensates the threshold voltage of each driving transistor by storing the threshold voltage of the driving transistor and the data signal in the capacitor during a period for detecting the threshold voltage of the driving transistor.

The compensation circuit of the external compensation method includes a sensing transistor connected with the driving transistor of the pixel circuit (PC); a sensing line connected with the sensing transistor and formed in the display panel 110; and a threshold voltage sensing circuit connected with the sensing line and formed in the panel driver 130. The compensation circuit of the external compensation method senses the threshold voltage of the driving transistor through the sensing line when the sensing transistor is driven by the use of threshold voltage sensing circuit, and compensates input data (RGB) on the basis of the sensed threshold voltage of the driving transistor, to thereby compensate the threshold voltage of each driving transistor.

The temperature sensing unit 120 includes at least one temperature sensor, wherein the temperature sensor is provided in the display panel 110 or a supporting member for supporting the display panel 110; and the temperature sensor senses a temperature of the display panel 110 or a surrounding temperature by each unit of at least one frame, and generates temperature data (TD) based on the sensed temperature. For example, the temperature sensing unit 120 may be formed of one temperature sensor provided in a central portion of a rear surface of the display panel 110. According to another example, the temperature sensing unit 120 may include a plurality of temperature sensors provided at fixed intervals on the rear surface of the display panel 110; or a plurality of temperature sensors provided at irregular intervals, wherein an interval between each of the temperature sensors may be gradually decreased from the edge portion of the rear surface of the display panel 110 toward the central portion of the rear surface of the display panel 110 due to a relatively low heat emission in the central portion of display panel 110, or the number of temperature sensors in a unit area may be gradually increased from the edge portion of the rear surface of the display panel 110 toward the central portion of the rear surface of the display panel 110 due to the relatively low heat emission in the central portion of display panel 110. According to another example, the temperature sensing unit 120 may include a plurality of chip-type temperature sensors or a plurality of resistance temperature sensors of thin film resistors arranged at fixed intervals in an entire non-display area of the display panel 110. In this case, the plurality of resistance temperature sensors are formed in the thin film type so as to make the resistance properties be changeable according to the temperature, whereby the resistance temperature sensors generate the temperature data (TD) by the resistance change according to the temperature.

The panel driver 130 controls the data signal (Vdata) to be supplied to each pixel (P) so as to make the current consumption of the display panel 110 be lower than the preset current limit value on the basis of the input data (RGB) and the temperature data (TD) supplied from the temperature sensing unit 120; and makes the organic light emitting device (OLED) of each pixel (P) emit light for each unit of a horizontal period by the use of controlled data signal (Vdata). For this, the panel driver 130 includes a data driver 132, a scanning driver 134, and a controller 136.

The data driver 132 is supplied with a plurality of reference gamma voltage (RGV), a data control signal (DCS) and conversion data (DATA) from the controller 136. Accordingly, the data driver 132 converts the conversion data (DATA) of digital type into the data signal (Vdata) of analog type according to the data control signal (DCS) by the use of reference gamma voltages (RGV); and then supplies the data signal (Vdata) of analog type to the data line (DL) by each unit of the horizontal period of the display panel 110.

The scanning driver 134 is supplied with a scanning control signal (SCS) from the controller 136. The scanning driver 134 generates a scanning signal (SS) according to the scanning control signal (SCS), and then sequentially supplies the generated scanning signal (SS) to the plurality of scanning lines (SL). Accordingly, the switching transistor of each pixel circuit (PC) is turned-on by the scanning signal (SS) supplied to the scanning line (SL), whereby the data signal (Vdata) supplied to the data line (DL) is supplied to a gate electrode of the driving transistor, and the driving transistor supplies the data current corresponding to the data signal (Vdata) to the organic light emitting device (OLED), to thereby make the organic light emitting device (OLED) emit light. The scanning driver 134 may be formed in the non-display area at one side and/or the other side of the display panel 110 by Gate-In-Panel (GIP) method during a thin film transistor process of the aforementioned display panel 110; or the scanning driver 134 of a chip type may be mounted on the non-display area by Chip-On-Glass (COG) method.

The controller 136 controls a driving timing for each of the data driver 132 and the scanning driver 134 according to a timing synchronous signal (TSS) input from an external system body (not shown) or graphic card (not shown). That is, the controller 136 generates the data control signal (DCS) on the basis of timing synchronous signal (TSS) such as vertical synchronous signal (Vsync), horizontal synchronous signal (Hsync), data enable (DE) and clock (DCLK); and controls the driving timing for the data driver 132 according to the data control signal (DCS). Also, the controller 136 controls the driving timing for the scanning driver 134 by generating the scanning control signal (SCS).

Also, the controller 136 generates the conversion data (DATA) by aligning the input data (RGB), input from the external system body (not shown) or graphic card (not shown), to be appropriate for the driving of the display panel 110, or supplies the corrected conversion data (DATA) to the data driver 132.

The controller 136 controls the data signal (Vdata) to be supplied to each pixel (P) so as to make the current consumption of the display panel 110 be lower than the preset current limit value on the basis of the conversion data (DATA) and the temperature data (TD) supplied from the temperature sensing unit 120. In this case, the controller 136 controls at least one of the conversion data (DATA) and the plurality of reference gamma voltages (RGV) used for converting the conversion data (DATA) into the data signal (Vdata) on the basis of the conversion data (DATA) and the temperature data (TD) when the data signal (Vdata) is controlled so as to make the current consumption of the display panel 110 to be lower than the preset current limit value.

Accordingly, the apparatus for driving the organic light emitting display device according to the embodiment of the present invention controls the current consumption of the display panel 110 according to the temperature of the display panel 110 or the surrounding temperature, so that it is possible to prevent the lifespan of organic light emitting device (OLED) from being decreased due to a deviation of the current consumption according to the temperature. Especially, the apparatus for driving the organic light emitting display device according to the embodiment of the present invention controls the current consumption of the display panel 110 to be lower than the preset current limit value according to the temperature of the display panel 110 or the surrounding temperature, so that it is possible to prevent shut-down of the power supplier caused by overcurrent of the display panel 110, and further to improve reliability of apparatus (or product).

Figure 3:
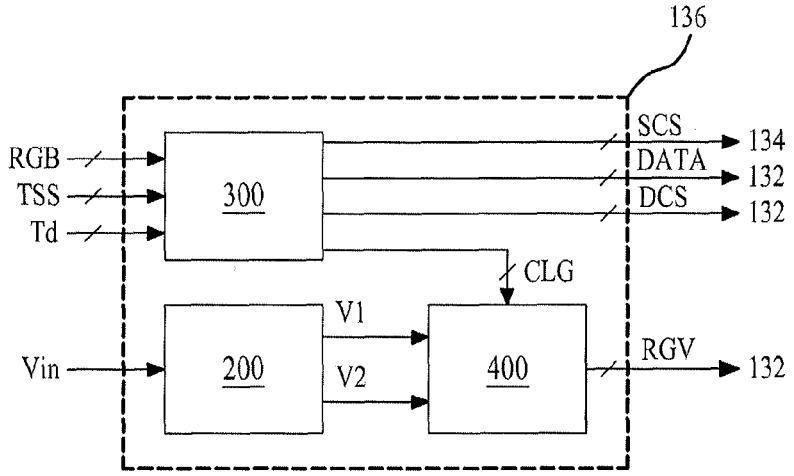
FIG. 3 is a block diagram illustrating a controller, shown in FIG. 2, according to the first embodiment of the present invention.

FIG. 3 is a block diagram illustrating the controller, shown in FIG. 2, according to the first embodiment of the present invention.

Referring to FIG. 3, the controller 136 according to the first embodiment of the present invention generates a current limit gain value (CLG) for controlling the current consumption of the display panel 110 to be lower than the preset current limit value on the bases of the input data (RGB) and the aforementioned temperature data (TD); and generates the plurality of reference gamma voltages (RGV) by the use of generated current limit gain value (CLG). Also, the controller 136 according to the first embodiment of the present invention generates the data control signal (DCS) and the scanning control signal (SCS) on the basis of the input timing synchronous signal (TSS); and supplies the data control signal (DCS) to the data driver 132, and supplies the scanning control signal (SCS) to the scanning driver 134. For this, the controller 136 according to the first embodiment of the present invention includes a power supplier 200, a timing controller 300, and a reference gamma voltage generator 400. The controller 136 may be a control board or control printed circuit board (control PCB) connected with the display panel 110, wherein the control board or control PCB may be provided with the power supplier 200, the timing controller 300, and the reference gamma voltage generator 400 mounted thereon.

The power supplier 200 generates and outputs various driving voltages for displaying the image on the display panel 110 by the use of input power (Vin) supplied from the external.

The timing controller 300 generates the aforementioned data control signal (DCS) and the scanning control signal (SCS) on the basis of the timing synchronous signal (TSS); generates the conversion data (DATA) by converting the input data into the data appropriate for the display panel 110; and generates the current limit gain value (CLG) so as to make the current consumption of the display panel 110 be lower than the preset current limit value on the basis of the input data (RGB), the conversion data (DATA), and the temperature data (TD). In this case, the current limit value may be set based on the allowable current value for preventing shut-down of the power supplier 200 caused by the overcurrent, the size of the display panel 110, the decrease in lifespan due to the light-emitting operation of the organic light emitting device, power consumption, and the cost of power supplier 200. The timing controller 300 will be described in detail with reference to FIGS. 4 and 5.

The reference gamma voltage generator 400 determines voltage levels of first and second driving voltages (V1, V2) for generating the gamma voltage from the power supplier 200 according to the current limit gain value (CLG) supplied from the timing controller 300; divides the first and second driving voltages (V1, V2) into the determined voltage levels; and supplies the plurality of reference gamma voltages (RGV) generated differently from one another to the data driver 132.

The reference gamma voltage generator 400 according to one embodiment of the present invention generates a plurality of common reference gamma voltages (RGV) which are applied in common to convert the input data (RGB) of red, green and blue colors into the data signal (Vdata) according to the current limit gain value (CLG).

The reference gamma voltage generator 400 according to another embodiment of the present invention may generate a plurality of red reference gamma voltages, a plurality of green reference gamma voltages, and a plurality of blue reference gamma voltages which are separately (or individually) applied to convert the input data (RGB) of red, green and blue colors into the separate (or individual) data signal (Vdata) according to the current limit gain value (CLG).

Further, if the unit pixel of the display panel 100 comprise the red pixel, green pixel, blue pixel and white pixel, the reference gamma voltage generator 400 according to another embodiment of the present invention may generate the plurality of red, green, blue and white reference gamma voltages, which are different from one another, according to the current limit gain value (CLG).

The aforementioned reference gamma voltage generator 400 may be realized in a programmable gamma integrated circuit (programmable gamma IC) for generating the plurality of reference gamma voltages (RGV) according to the current limit gain value (CLG).

The controller 136 according to the first embodiment of the present invention calculates the current limit gain value (CLG) on the basis of the input data (RGB) and the temperature data (TD); and generates the plurality of reference gamma voltages (RGV) according to the calculated current limit gain value (CLG), whereby the current consumption of the display panel 110 is controlled to be lower than the preset current limit value even though the temperature of display panel 110 is changed.

Figure 4:
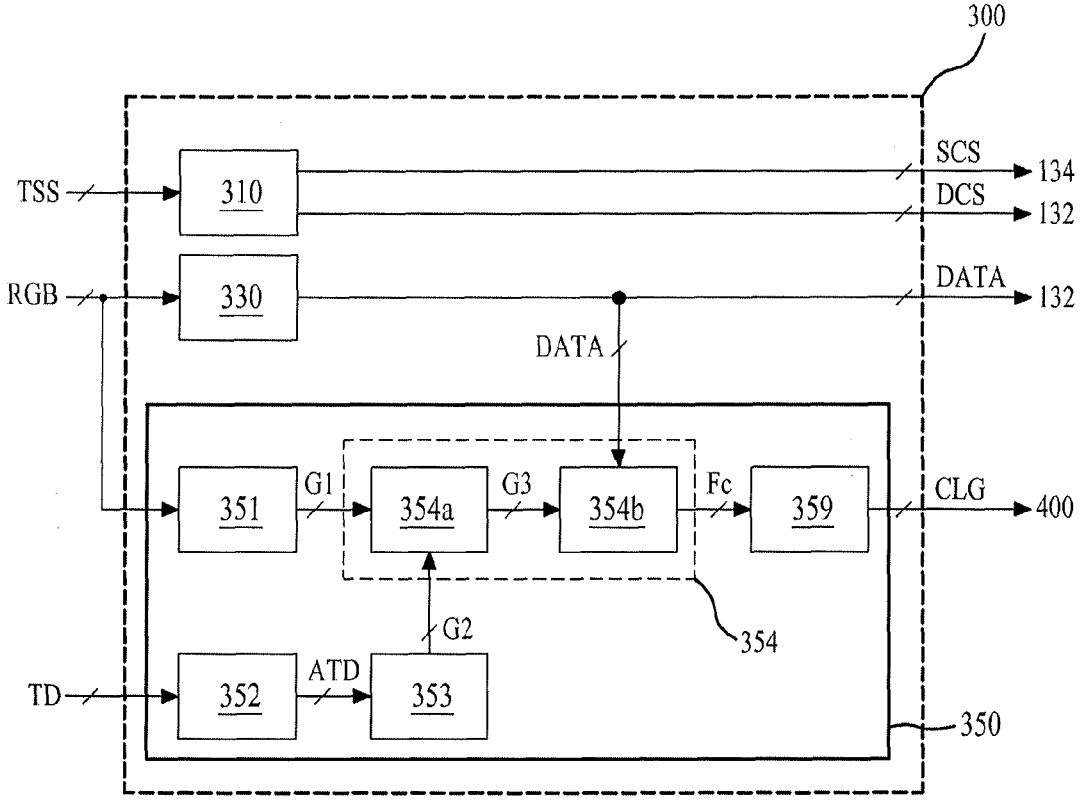
FIG. 4 is a block diagram illustrating a timing controller, shown in FIG. 3, according to the first embodiment of the present invention.

FIG. 4 is a block diagram illustrating the timing controller, shown in FIG. 3, according to the first embodiment of the present invention.

Referring to FIGS. 3 and 4, the timing controller 300 according to the first embodiment of the present invention includes a control signal generator 310, a data processor 330, and a temperature compensator 350.

As mentioned above, the control signal generator 310 generates the aforementioned data control signal (DCS) and the scanning control signal (SCS) on the basis of the timing synchronous signal (TSS); and supplies the generated data control signal (DCS) to the data driver 132, and supplies the generated scanning control signal (SCS) to the scanning driver 134.

The data processor 330 generates the conversion data (DATA) by aligning the input data (RGB) of red, green and blue colors, stored in a memory device, so as to be appropriate for the driving of the display panel 110; and supplies the generated conversion data (DATA) to the data driver 132 and the temperature compensator 350.

The temperature compensator 350 calculates an input data gain value (G1) based on the input data (RGB) of one frame, and a temperature gain value (G2) based on the temperature data (TD); calculates a frame current value (Fc) from the conversion data (DATA) by the use of calculated input data gain value (G1) and temperature gain value (G2); and generates the current limit gain value (CLG) based on the calculated frame current value (Fc). For this, the temperature compensator 350 includes an input data gain value calculator 351, a temperature data corrector 352, a temperature gain value calculator 353, a frame current calculator 354, and a current limit gain value calculator 359.

The input data gain value calculator 351 calculates an average picture level for the input data (RGB) of one frame by analyzing the input data (RGB) of one frame stored in the memory device; and calculates the input data gain value (G1) based on the calculated average picture level. In this case, the input data gain value calculator 351 may calculate the average picture level by analyzing the input data (RGB) of red, green and blue colors according to each unit pixel; or may divide the input data (RGB) of the unit pixel into luminance component (Y) and chrominance component (CbCr), and calculate the average picture level by analyzing the luminance component (Y) of the unit pixel. Meanwhile, instead of calculating the average picture level by the use of input data (RGB) or luminance component (Y), the input data gain value calculator 351 may calculate the average picture level by generally-known various image-analyzing methods such as histogram according to the input data (RGB) of one frame. The input data gain value calculator 351 may comprise Look-Up-Table which is mapped with the input data gain value (G1) obtained by pretests based on the average picture level.

The temperature data corrector 352 corrects the temperature data (TD) supplied from the aforementioned temperature sensing unit 120, and more particularly, averages the temperature data (TD), to thereby generate the averaged temperature data (ATD). Then, the temperature data corrector 352 supplies the averaged temperature data (ATD) to the temperature gain value calculator 353. If the temperature sensing unit 120 is provided with the plurality of temperature sensors, the temperature data corrector 352 is needed. However, if the temperature sensing unit 120 is provided with one temperature sensor, it is possible to omit the temperature data corrector 352. For the following description of the present invention, it is assumed that the temperature data corrector 352 is omitted.

The temperature gain value calculator 353 generates the temperature gain value (G2) for controlling the current consumption based on the temperature data (TD) supplied from the aforementioned temperature sensing unit 120, that is, the data current; and supplies the generated temperature gain value (G2) to the frame current calculator 354. The temperature gain value calculator 353 may comprise Look-Up-Table which is mapped with the temperature gain value (G2) obtained by pretests based on the current consumption according to the temperature. The current consumption of the display panel 110 is increased in proportion to the temperature, that is, the current consumption of the display panel 110 is increased according to the increase of temperature. In this respect, the temperature gain value (G2) may be set to make the current consumption of the display panel 110 be decreased according to the increase of temperature.

The frame current calculator 354 calculates the frame current value (Fc) for the conversion data (DATA) of one frame supplied from the data processor 330 by the use of input data gain value (G1) supplied from the input data gain value calculator 351 and temperature gain value (G2) supplied from the temperature gain value calculator 353. For this, the frame current calculator 354 may include a frame current gain value generator 354*a* and a frame current generator 354*b*.

The frame current gain value generator 354*a* generates a frame current gain value (G3) by the use of input data gain value (G1) and temperature gain value (G2). In this case, the frame current gain value generator 354*a* may generate the frame current gain value (G3) by dividing the input data gain value (G1) by the temperature gain value (G2), or may generate the frame current gain value (G3) by subtracting the temperature gain value (G2) from the input data gain value (G1).

The frame current generator 354*b* reflects the frame current gain value (G3) on the conversion data (DATA) to be supplied to each pixel (P) of the display panel 110 for one frame; and generates the frame current value (Fc) by predicting the current value flowing in the display panel 110 according to the conversion data (DATA) on which the frame current gain value (G3) is reflected. In this case, the frame current generator 354*b* may reflect the frame current gain value (G3) on the conversion data (DATA) by multiplying the conversion data (DATA) to be supplied to each pixel (P) and the frame current gain value (G3) together.

The current limit gain value calculator 359 calculates the current limit gain value (CLG) for controlling the plurality of reference gamma voltages (RGV) so as to make the frame current value (Fc) supplied from the frame current generator 354*b* be lower than the preset current limit value; and supplies the calculated current limit gain value (CLG) to the reference gamma voltage generator 400.

The current limit gain value calculator 359 according to one embodiment of the present invention selects a reference temperature compensation gain value corresponding to the frame current value (Fc) among a plurality of reference temperature compensation gain values which are set according to the current limit value; and calculates the current limit gain value (CLG) by the selected reference temperature compensation gain value. In this case, the reference temperature compensation gain values corresponding to the frame current value (Fc) which is smaller than the preset current limit value and is selected from the plurality of frame current values (Fc) may be determined to the values which does not increase or decrease the frame current value (Fc), for example, "1". Meanwhile, the reference temperature compensation gain values corresponding to the frame current value (Fc) which is larger than the preset current limit value and is selected from the plurality of frame current values (Fc) may be determined to the values which are reflected to make the frame current value (Fc) be lower than the preset current limit value, for example, the values which are obtained by dividing the current limit value by the frame current value (Fc).

The current limit gain value calculator 359 according to another embodiment of the present invention may calculate the current limit gain value (CLG) through the calculation of the frame current value (Fc) and the current limit value. For example, the current limit gain value calculator 359 calculates the current limit gain value (CLG) by dividing a reference current consumption value which is set to be lower than the current limit value by the frame current value (Fc). In this case, the current consumption of the display panel 110 does not exceed the current limit value even though the temperature is changed, whereby the current consumption is constantly controlled to the reference current consumption value. The reference current consumption value may be set according to a luminance value of the display panel 110, wherein the luminance value is preset by a user.

The current limit gain value calculator 359 according to another embodiment of the present invention compares the frame current value (Fc) with the current limit value; and calculates the current limit gain value (CLG) by the temperature gain value (G2) supplied from the temperature gain value calculator 353, or by dividing the current limit value by the frame current value (Fc) according to the comparison result. For example, if the frame current value (Fc) is lower than the current limit value, the current limit gain value calculator 359 calculates the current limit gain value (CLG) by the temperature gain value (G2) as it is. Meanwhile, if the frame current value (Fc) is higher than the current limit value, the current limit gain value calculator 359 calculates the current limit gain value (CLG) by dividing the current limit value by the frame current value (Fc).

Figure 5:
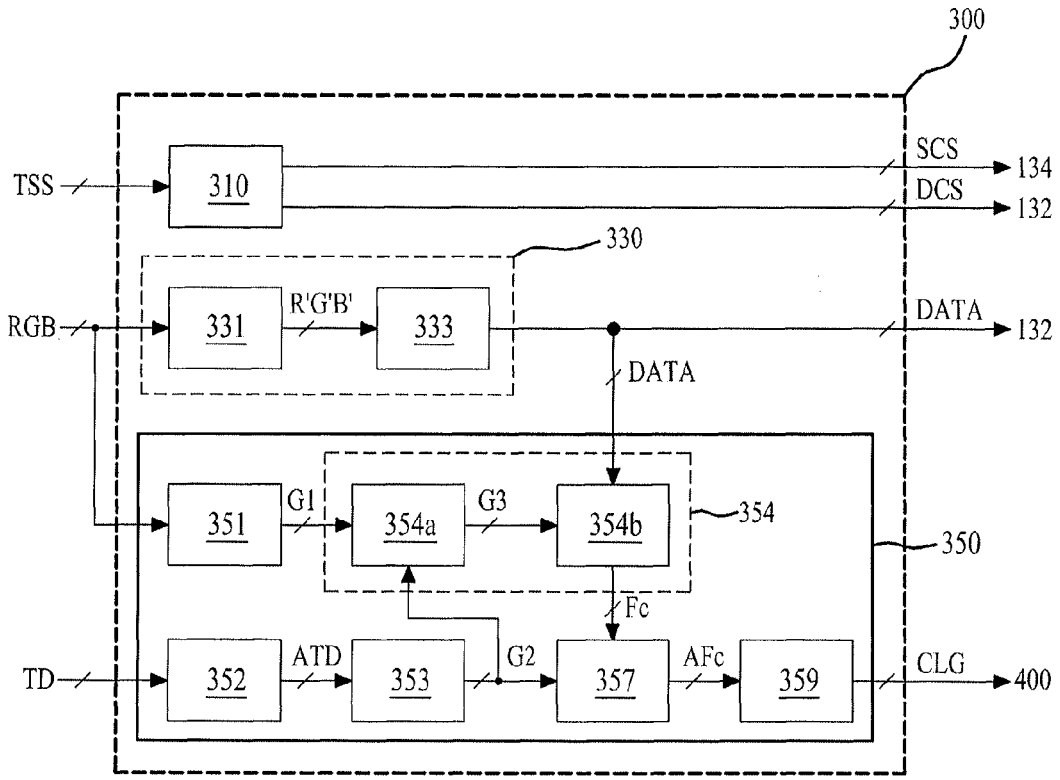
FIG. 5 is a block diagram illustrating a timing controller, shown in FIG. 3, according to the second embodiment of the present invention.

FIG. 5 is a block diagram illustrating the timing controller, shown in FIG. 3, according to the second embodiment of the present invention.

Referring to FIGS. 3 and 5, the timing controller 300 according to the second embodiment of the present invention includes a control signal generator 310, a data processor 330, and a temperature compensator 350. Except structures of the data processor 330 and the temperature compensator 350, the timing controller 300 according to the second embodiment of the present invention is identical in structure to the aforementioned timing controller 300 according to the first embodiment of the present invention shown in FIG. 4, whereby only peculiar structures of the second embodiment will be described in detail.

The data processor 330 converts the input data (RGB) of red, green and blue colors provided from the external into the conversion data (DATA) of red, green, blue and white colors; and supplies the conversion data (DATA) to the data driver 132 and the temperature compensator 350. For this, the data processor 330 includes a data aligner 331 and a data converter 333.

The data aligner 331 generates the aligned data (R'G'B') by aligning the input data (RGB) of red, green and blue colors, stored in the memory device, so as to be appropriate for the driving of the display panel 110; and supplies the aligned data (R'G'B') to the data converter 333.

The data converter 333 extracts the white data on the basis of the input data (RGB) of red, green and blue colors stored in the memory device; and generates the conversion data (DATA) comprising the red, green, blue and white data. In this case, the white data may be generated by the input data with the lowest value among the input data (RGB) of red, green and blue colors for each unit pixel, but not necessarily. The white data may be generated in various methods for converting 3-color data (RGB) into 4-color data (RGBW).

As mentioned above, the data processor 330 converts the input data (RGB) of red, green and blue colors into the conversion data (DATA) of red, green, blue and white colors, whereby the unit pixel of the aforementioned display panel 110 comprises the red, green, blue and white pixels.

The temperature compensator 350 includes an input data gain value calculator 351, a temperature data corrector 352, a temperature gain value calculator 353, a frame current calculator 354, a frame current corrector 357, and a current limit gain value calculator 359. Except structures of the frame current corrector 357 and the current limit gain value calculator 359, the temperature compensator 350 of the timing controller 300 according to the second embodiment of the present invention is identical in structure to that of the timing controller 300 according to the first embodiment of the present invention shown in FIG. 4, whereby a detailed explanation for the same parts will be omitted.

The frame current corrector 357 generates the corrected frame current value (AFc) by correcting the frame current value (Fc) supplied from the frame current calculator 354 according to the temperature gain value (G2) supplied from the temperature gain value calculator 353; and supplies the corrected frame current value (AFc) to the current limit gain value calculator 359. For example, the corrected frame current value (AFc) may be generated by multiplying the frame current value (Fc) and the temperature gain value (G2) together. The frame current corrector 357 corrects the frame current value (Fc) generated from the conversion data (DATA) comprising the red, green, blue and white data by the use of temperature gain value (G2) so that it is possible to accurately control the current consumption of the display panel 110 according to the frame current value (Fc).

The current limit gain value calculator 359 calculates the current limit gain value (CLG) for controlling the plurality of reference gamma voltages (RGV) so as to make the frame current value (AFc) corrected by the frame current corrector 357 be lower than the present current limit value; and supplies the calculated current limit gain value (CLG) to the reference gamma voltage generator 400. Except that the corrected frame current value (AFc) is used to calculate the current limit gain value (CLG), the current limit gain value calculator 359 according to the second embodiment of the present invention is identical in structure to the aforementioned current limit gain value calculator 359, shown in FIG. 4, according to the first embodiment of the present invention, whereby a detailed explanation for the current limit gain value calculator 359 will be substituted by the above description.

Figure 6:
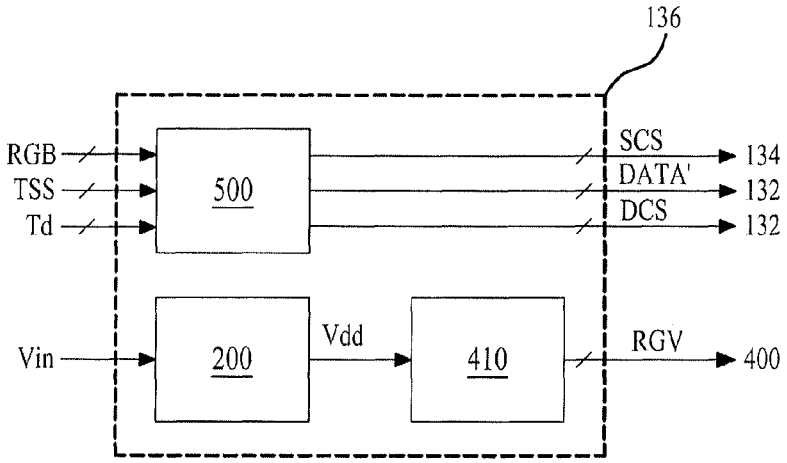
FIG. 6 is a block diagram illustrating a controller, shown in FIG. 2, according to the second embodiment of the present invention.

FIG. 6 is a block diagram illustrating the controller, shown in FIG. 2, according to the second embodiment of the present invention.

Referring to FIG. 6, the controller 136 according to the second embodiment of the present invention generates a current limit gain value (CLG) for controlling the current consumption of the display panel 110 to be lower than the preset current limit value on the bases of the input data (RGB) and the aforementioned temperature data (TD); and generates the correction data (DATA') by correcting the conversion data (DATA) converted from the input data (RGB) by the use of generated current limit gain value (CLG). The controller 136 according to the second embodiment of the present invention generates the aforementioned data control signal (DCS) and the scanning control signal (SCS) on the basis of the input timing synchronous signal (TSS); and supplies the data control signal (DCS) to the data driver 132, and supplies the scanning control signal (SCS) to the scanning driver 134. For this, the controller 136 according to the second embodiment of the present invention includes a power supplier 200, a reference gamma voltage generator 410, and a timing controller 500.

The power supplier 200 generates and outputs various driving voltages for displaying the image on the display panel 110 by the use of input power (Vin) supplied from the external.

The reference gamma voltage generator 410 determines voltage levels of first and second driving voltages (V1, V2) for generating the gamma voltage from the power supplier 200;

divides the first and second driving voltages (V1, V2) into the determined voltage levels; and supplies the plurality of reference gamma voltages (RGV) generated differently from one another to the data driver 132. Unlike the aforementioned gamma voltage generator 400 of the timing controller 136 according to the first embodiment of the present invention, the gamma voltage generator 410 of the controller 136 according to the second embodiment of the present invention generates the plurality of reference gamma voltages (RGV), which are different from one another, regardless of the current limit gain value (CLG).

The reference gamma voltage generator 410 according to one embodiment of the present invention generates a plurality of common reference gamma voltages (RGV) which are applied in common to convert the input data (RGB) of red, green and blue colors into the data signal (Vdata).

The reference gamma voltage generator 410 according to another embodiment of the present invention may generate a plurality of red reference gamma voltages, a plurality of green reference gamma voltages, and a plurality of blue reference gamma voltages which are separately (or individually) applied to convert the input data (RGB) of red, green and blue colors into the separate (or individual) data signal (Vdata).

Further, if the unit pixel of the display panel 100 comprises the red pixel, green pixel, blue pixel and white pixel, the reference gamma voltage generator 410 according to another embodiment of the present invention may generate the plurality of red, green, blue and white reference gamma voltages, which are respectively set in different voltage levels.

The aforementioned reference gamma voltage generator 410 may be realized in a programmable gamma integrated circuit (programmable gamma IC) for generating the plurality of reference gamma voltages (RGV) which are different from one another, or may be realized in at least one voltage-dividing resistance string, provided with a plurality of resistances, and a plurality of nodes respectively interposed between each of the resistances, for outputting the plurality of reference gamma voltages (RGV) which are different from one another.

The timing controller 500 generates the data control signal (DCS) and the scanning control signal (SCS) on the basis of the timing synchronous signal (TSS); and generates the conversion data (DATA) by converting the input data (RGB) into the data appropriate for the display panel 110. The timing controller 500 generates the current limit gain value (CLG) so as to make the current consumption of the display panel 110 be lower than the preset current limit value on the basis of the input data (RGB), the conversion data (DATA) and the temperature data (TD); and generates the correction data (DATA') by correcting the conversion data (DATA) by the use of generated current limit gain value (CLG). That is, the timing controller 500 corrects the input data (RGB) so as to make the current consumption of the display panel 110 be lower than the preset current limit value according to the temperature of the display panel 110 or the surrounding temperature. The timing controller 500 will be described in detail with references to FIGS. 7 and 8.

The controller 136 according to the second embodiment of the present invention calculates the current limit gain value (CLG) on the basis of the input data (RGB) and the temperature data (TD); and generates the correction data (DATA') according to the calculated current limit gain value (CLG), whereby the current consumption of the display panel 110 is controlled to be lower than the current limit value even though the temperature of the display panel 110 is changed.

Figure 7:
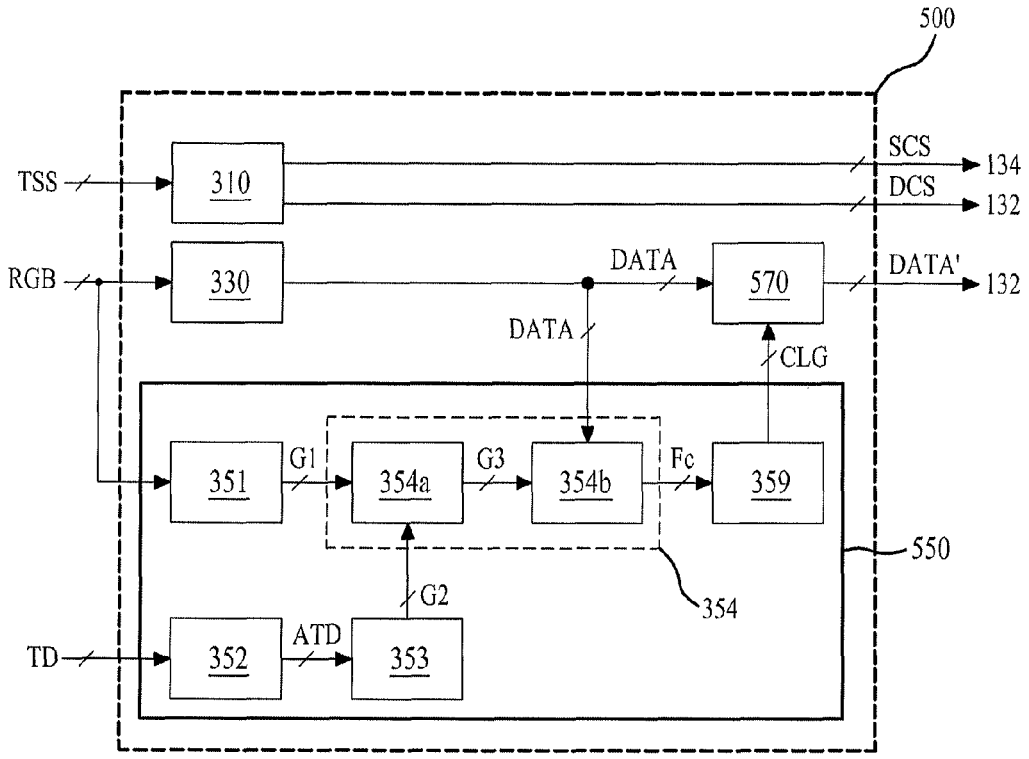
FIG. 7 is a block diagram illustrating a timing controller, shown in FIG. 6, according to the third embodiment of the present invention.

FIG. 7 is a block diagram illustrating the timing controller, shown in FIG. 3, according to the third embodiment of the present invention.

Referring to FIGS. 6 and 7, the timing controller 300 according to the third embodiment of the present invention includes a control signal generator 310, a data processor 330, a temperature compensator 550, and a data corrector 570.

The control signal generator 310 and the data processor 330 are identical in structure to those of the timing controller 300, shown in FIG. 4, according to the first embodiment of the present invention, whereby a detailed explanation for the same parts will be omitted.

Except that the current limit gain value (CLG) generated in the current limit gain value calculator 359 of the temperature compensator 350 is supplied to the data corrector 570 instead of the reference gamma voltage generator 410, the temperature compensator 550 is identical in structure to the aforementioned temperature compensator 350 of the timing controller 300 according to the first embodiment of the present invention shown in FIG. 4, whereby a detailed explanation for the temperature compensator 550 will be substituted by the above description.

The data corrector 570 generates the correction data (DATA') by correcting the conversion data (DATA) supplied from the data processor 330 by the use of current limit gain value (CLG) supplied from the temperature compensator 550. For example, the data corrector 570 may generate the correction data (DATA') by multiplying the conversion data (DATA) to be supplied to each pixel (P) by the current limit gain value (CLG).

Figure 8:
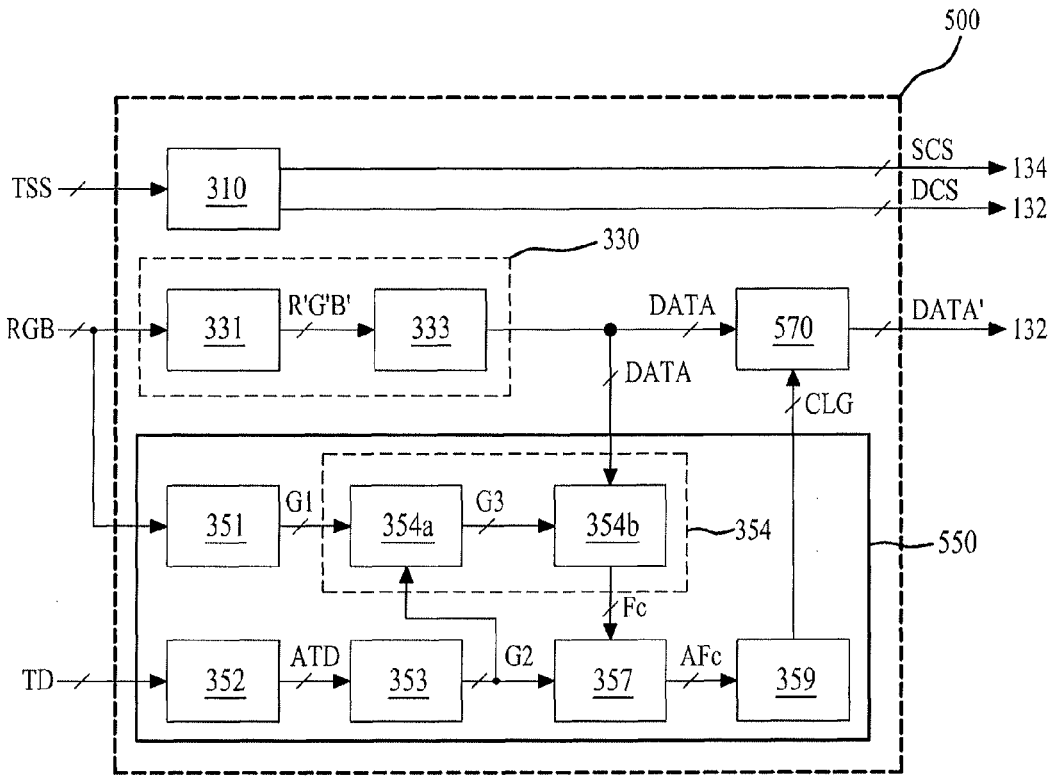
FIG. 8 is a block diagram illustrating a timing controller, shown in FIG. 6, according to the fourth embodiment of the present invention.

FIG. 8 is a block diagram illustrating the timing controller, shown in FIG. 6, according to the fourth embodiment of the present invention.

Referring to FIGS. 6 and 8, the timing controller 300 according to the fourth embodiment of the present invention includes a control signal generator 310, a data processor 330, a temperature compensator 550, and a data corrector 570.

The control signal generator 310 and the data processor 330 are identical in structure to those of the timing controller 300, shown in FIG. 5, according to the second embodiment of the present invention, whereby a detailed explanation for the same parts will be omitted.

Except that the current limit gain value (CLG) generated in the current limit gain value calculator 359 of the temperature compensator 550 is supplied to the data corrector 570 instead of the reference gamma voltage generator 400, the temperature compensator 550 is identical in structure to the aforementioned temperature compensator 350 of the timing controller 300 according to the second embodiment of the present invention shown in FIG. 5, whereby a detailed explanation for the temperature compensator 550 will be substituted by the above description.

The data corrector 570 generates the correction data (DATA') by correcting the conversion data (DATA) supplied from the data processor 330 by the use of current limit gain value (CLG) supplied from the temperature compensator 550. For example, the data corrector 570 may generate the correction data (DATA') by multiplying the conversion data (DATA) to be supplied to each pixel (P) by the current limit gain value (CLG).

Figure 9:
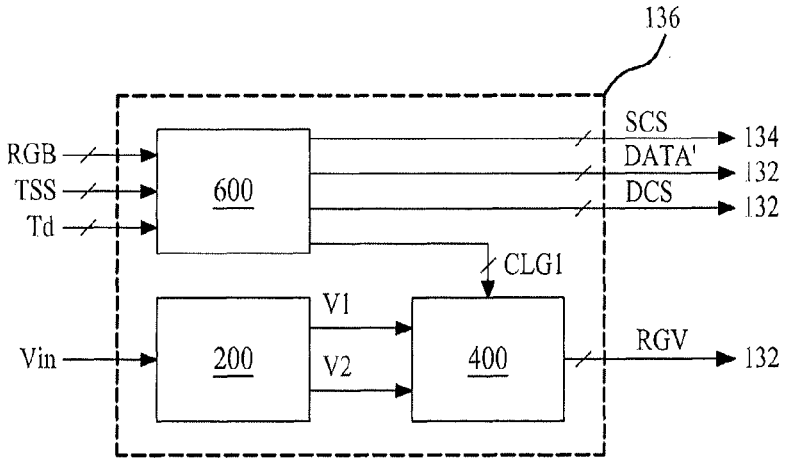
FIG. 9 is a block diagram illustrating a controller, shown in FIG. 2, according to the third embodiment of the present invention.

FIG. 9 is a block diagram illustrating the controller, shown in FIG. 2, according to the third embodiment of the present invention.

Referring to FIG. 9, the controller 136 according to the third embodiment of the present invention generates a current limit gain value (CLG) for controlling the current consumption of the display panel 110 to be lower than the preset current limit value on the bases of the input data (RGB) and the aforementioned temperature data (TD); and generates the plurality of reference gamma voltages (RGB) by the use of generated current limit gain value (CLG), and simultaneously generates the correction data (DATA') by correcting the conversion data (DATA) converted from the input data (RGB). The controller 136 according to the third embodiment of the present invention generates the data control signal (DCS) and the scanning control signal (SCS) on the basis of the input timing synchronous signal (TSS); and supplies the data control signal (DCS) to the data driver 132, and supplies the scanning control signal (SCS) to the scanning driver 134. For this, the controller 136 according to the third embodiment of the present invention includes a power supplier 200, a reference gamma voltage generator 400, and a timing controller 600.

The power supplier 200 generates and outputs various driving voltages for displaying the image on the display panel 110 by the use of input power (Vin) supplied from the external.

The timing controller 600 generates the aforementioned data control signal (DCS) and the scanning control signal (SCS) on the basis of the timing synchronous signal (TSS); and controls the driving for each of the data driver 132 and the scanning driver 134.

Also, the timing controller 600 generates the conversion data (DATA) by converting the input data (RGB) to be appropriate for the display panel 110; and generates the current limit gain value (CLG) so as to make the current consumption of the display panel 110 be lower than the preset current limit value on the basis of the input data (RGB), the conversion data (DATA) and the temperature data (TD). Also, the timing controller 600 generates a current limit gain value (CLG1) for gamma voltage and a current limit gain value (CLG2) for data by dividing the current limit gain value (CLG) according to a preset proportion; and generates the correction data (DATA') by correcting the conversion data (DATA) by the use of current limit gain value for data. That is, the timing controller 600 controls the plurality of reference gamma voltages (RGV), and simultaneously corrects the input data (RGB) so as to make the current consumption of the display panel 110 be lower than the preset current limit value according to the temperature of the display panel 110 or the surrounding temperature.

Except that the plurality of reference gamma voltages (RGV) are generated by the use of current limit gain value (CLG1) for gamma voltage supplied from the timing controller 600, and are supplied to the data driver 132, the reference gamma voltage generator 400 of the controller 136 according to the third embodiment of the present invention is identical in structure to the reference gamma voltage generator 400 of the controller 136 according to the first embodiment of the present invention, whereby the same reference number is used therein, and a detailed explanation for the reference gamma voltage generator 400 will be substituted by the aforementioned description.

The controller 136 according to the third embodiment of the present invention calculates the current limit gain value (CLG) on the basis of the temperature data (TD) and the input data (RGB); and generates the correction data (DATA') according to the calculated current limit gain value (CLG), and simultaneously generates the plurality of reference gamma voltages (RGV), so that it is possible to make the current consumption of the display panel 110 be lower than the current limit value even though the temperature of the display panel 110 is changed.

Figure 10:
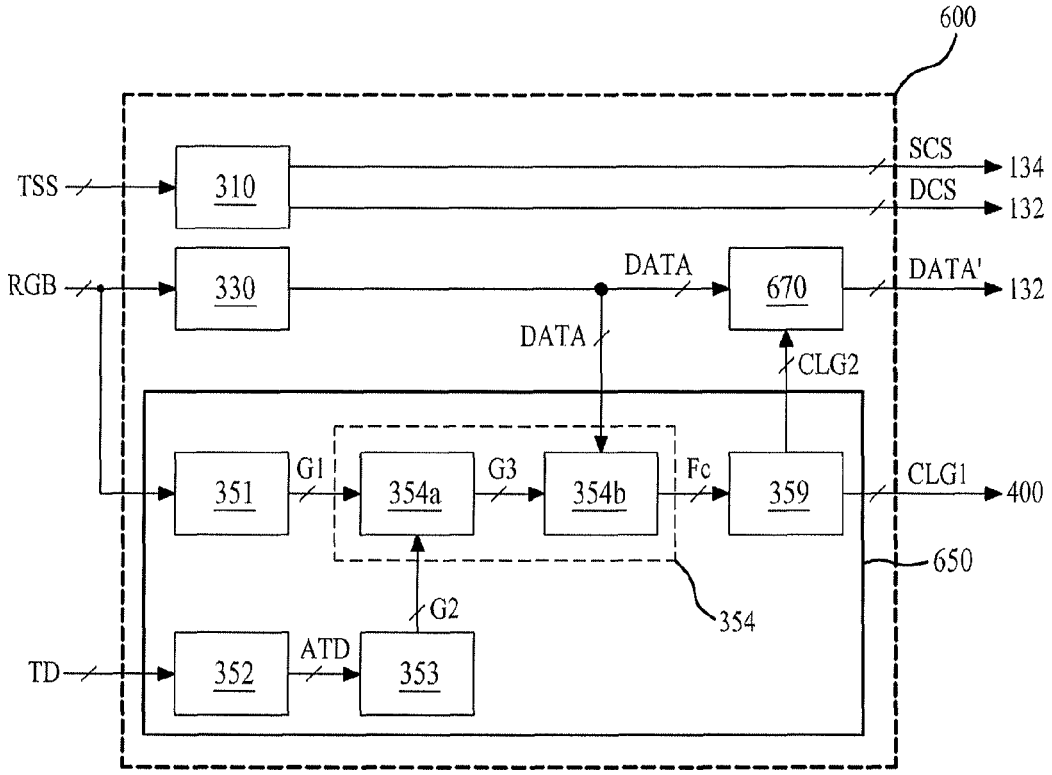
FIG. 10 is a block diagram illustrating a timing controller, shown in FIG. 9, according to the fifth embodiment of the present invention.

FIG. 10 is a block diagram illustrating the timing controller, shown in FIG. 9, according to the fifth embodiment of the present invention.

Referring to FIGS. 9 and 10, the timing controller 600 according to the fifth embodiment of the present invention includes a control signal generator 310, a data processor 330, a temperature compensator 650, and a data corrector 670.

The control signal generator 310 and the data processor 330 are identical in structure to those of the timing controller 300, shown in FIG. 4, according to the first embodiment of the present invention, whereby a detailed explanation for the same parts will be omitted.

The temperature compensator 650 is identical in structure to the temperature compensator 350 of the timing controller 300 according to the first embodiment of the present invention shown in FIG. 4. However, as mentioned above, a current limit gain value calculator 359 of the temperature compensator 650 generates the current limit gain value (CLG); generates a current limit gain value (CLG1) for gamma voltage and a current limit gain value (CLG2) for data by dividing the current limit gain value (CLG) according to a preset proportion; and supplies the current limit gain value (CLG1) for gamma voltage to the reference gamma voltage generator 400, and simultaneously supplies the current limit gain value (CLG2) for data to the data corrector 670. Accordingly, the aforementioned reference gamma voltage generator 400 generates the plurality of reference gamma voltages (RGV), which are different from one another, according to the current limit gain value (CLG1) for gamma voltage supplied from the temperature compensator 650 of the timing controller 600; and supplies the plurality of reference gamma voltages (RGV) to the data driver 132.

The data corrector 670 generates the correction data (DATA') by correcting the conversion data (DATA) supplied from the data processor 330 by the use of current limit gain value (CLG2) for data supplied from the temperature compensator 550. For example, the data corrector 670 may generate the correction data (DATA') by multiplying the conversion data (DATA) to be supplied to each pixel (P) by the current limit gain value (CLG2) for data.

Figure 11:
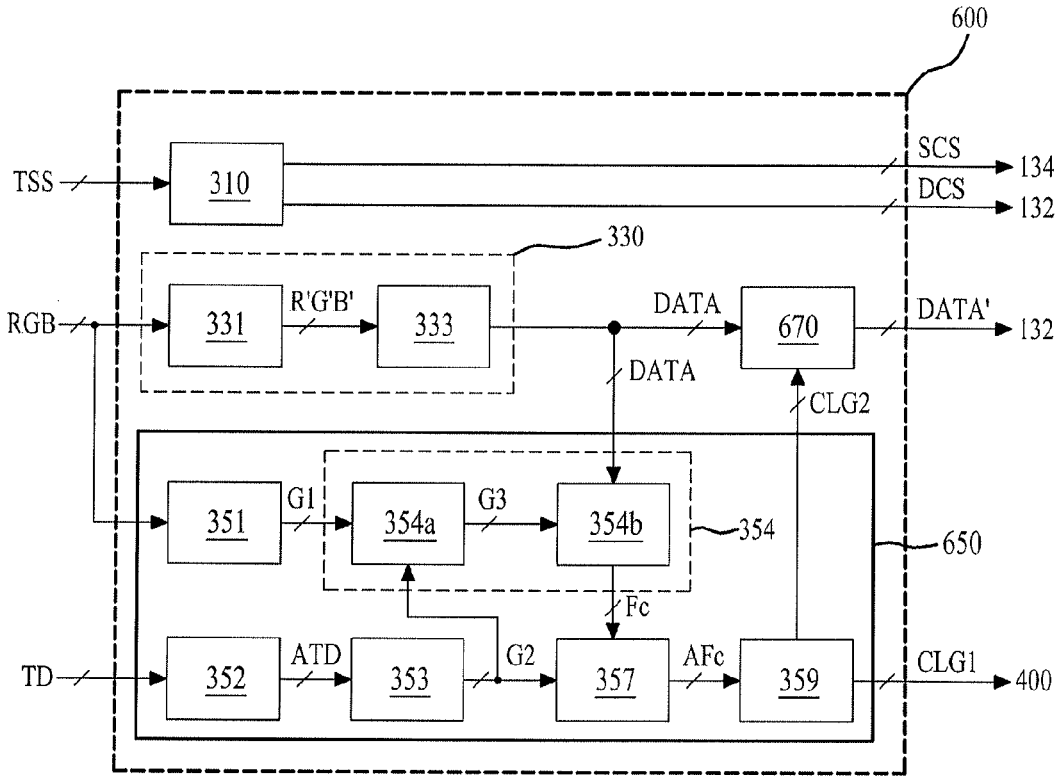
FIG. 11 is a block diagram illustrating a timing controller, shown in FIG. 9, according to the sixth embodiment of the present invention.

FIG. 11 is a block diagram illustrating the timing controller, shown in FIG. 9, according to the sixth embodiment of the present invention.

Referring to FIGS. 9 and 11, the timing controller 600 according to the sixth embodiment of the present invention includes a control signal generator 310, a data processor 330, a temperature compensator 650, and a data corrector 670.

The control signal generator 310 and the data processor 330 are identical in structure to those of the timing controller 300, shown in FIG. 5, according to the second embodiment of the present invention, whereby a detailed explanation for the same parts will be omitted.

The temperature compensator 650 is identical in structure to the temperature compensator 350 of the timing controller 300, shown in FIG. 5, according to the second embodiment of the present invention. However, as mentioned above, a current limit gain value calculator 359 of the temperature compensator 650 generates the current limit gain value (CLG); generates a current limit gain value (CLG1) for gamma voltage and a current limit gain value (CLG2) for data by dividing the current limit gain value (CLG) according to a preset proportion; and supplies the current limit gain value (CLG1) for gamma voltage to the reference gamma voltage generator 400, and simultaneously supplies the current limit gain value (CLG2) for data to the data corrector 670. Accordingly, the aforementioned reference gamma voltage generator 400 generates the plurality of reference gamma voltages (RGV), which are different from one another, according to the current limit gain value (CLG1) for gamma voltage supplied from the temperature compensator 650 of the timing controller 600; and supplies the plurality of reference gamma voltages (RGV) to the data driver 132.

The data corrector 670 generates the correction data (DATA') by correcting the conversion data (DATA) supplied from the data processor 330 by the use of current limit gain value (CLG2) for data supplied from the temperature compensator 550. For example, the data corrector 670 may generate the correction data (DATA') by multiplying the conversion data (DATA) to be supplied to each pixel (P) by the current limit gain value (CLG2) for data.

Figure 12:
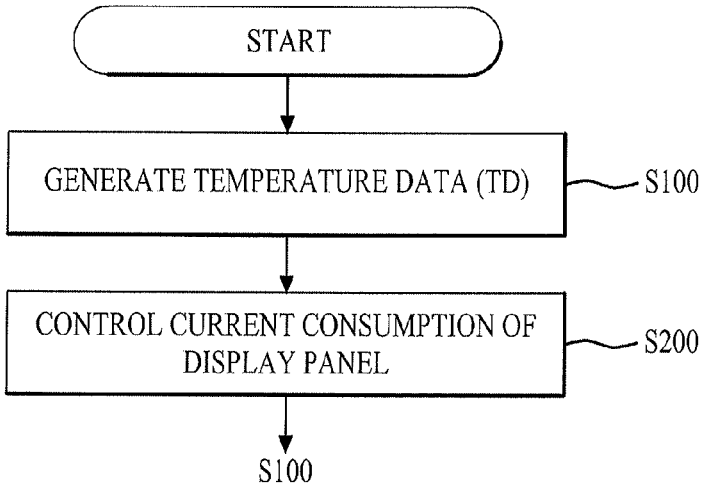
FIG. 12 is a flow chart illustrating a method for driving an organic light emitting display device according to the embodiment of the present invention.

FIG. 12 is a flow chart illustrating a method for driving the organic light emitting display device according to the embodiment of the present invention.

A method for driving the organic light emitting display device according to the embodiment of the present invention will be described with reference to FIG. 12 in connection with FIG. 2.

First, the temperature data (TD) is generated by sensing the temperature of the display panel 110 or the surrounding temperature through the use of temperature sensing unit 120 (S100).

Then, the current consumption of the display panel 110 is controlled to be lower than the preset current limit value on the basis of the input data (RGB) and the temperature data (TD) (S200). During the process of S200, the current consumption of the display panel 110 may be controlled to be lower than the preset current limit value on the basis of the input data (RGB) and the temperature data (TD) by controlling at least one of the input data (RGB) and the plurality of reference gamma voltages (RGV) used to convert the input data (RGB) into the data signal (Vdata) to be supplied to each pixel (P).

Figure 13:
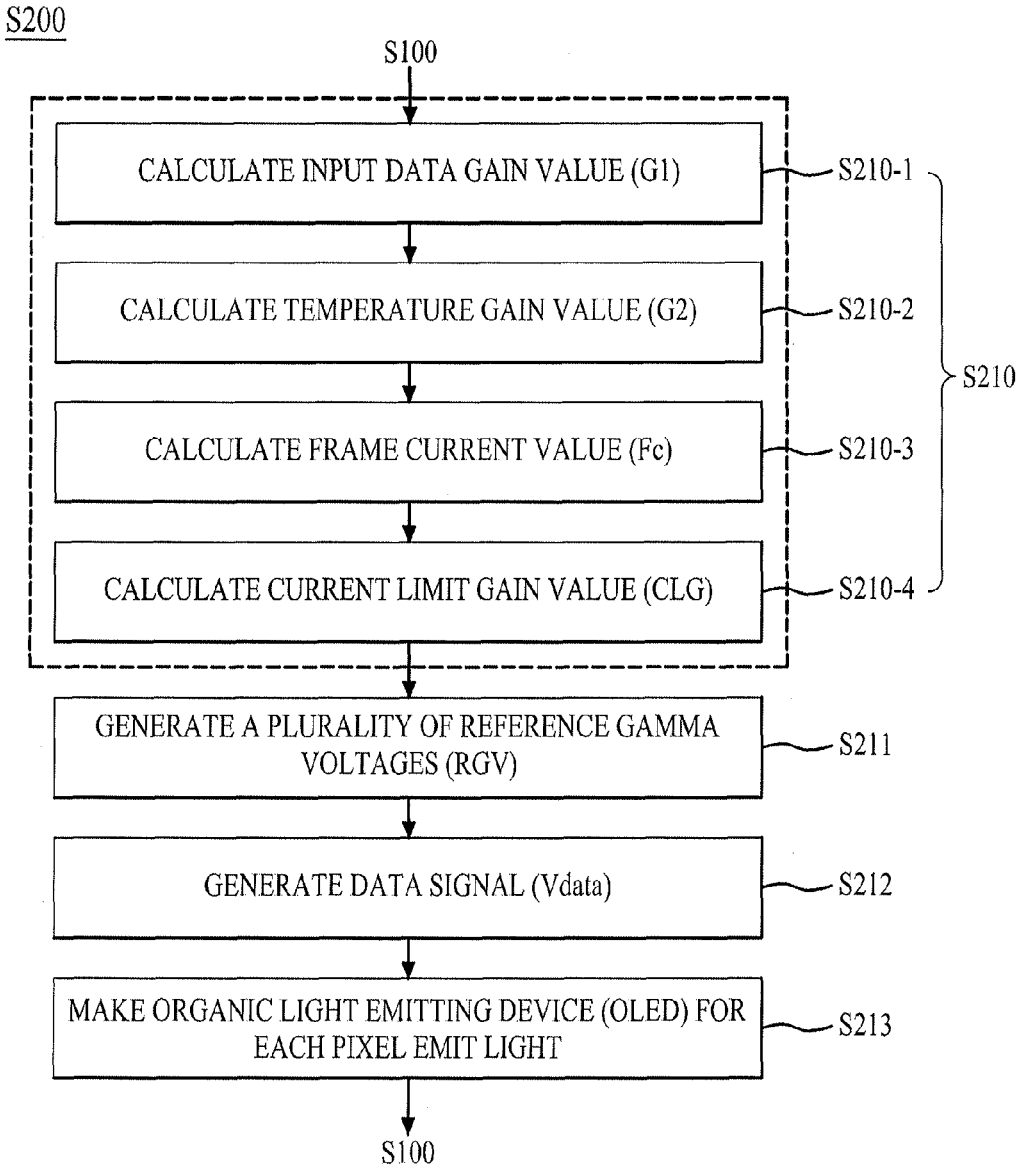
FIG. 13 is a flow chart illustrating a process for controlling current consumption of a display panel, shown in FIG. 12, according to the first embodiment of the present invention.

FIG. 13 is a flow chart illustrating the process for controlling the current consumption of the display panel, shown in FIG. 12, according to the first embodiment of the present invention.

First, the current limit gain value (CLG) is calculated for controlling the current consumption of the display panel 110 to be lower than the preset current limit value on the basis of the conversion data (DATA) converted from the input data (RGB) and the temperature data (TD) (S210). In more detail, as mentioned above, the process (S210) for calculating the current limit gain value (CLG) includes calculating the input data gain value (G1) on the basis of the input data (RGB) of one frame (S210-1); calculating the temperature gain value (G2) on the basis of the temperature data (TD) (S210-2); calculating the frame current value (Fc) from the conversion data (DATA) of one frame by the use of input data gain value (G1) and temperature gain value (G2) (S210-3); and generating the current limit gain value (CLG) on the basis of the frame current value (Fc) (S210-4). A detailed explanation about the process (S210) for calculating the current limit gain value (CLG) will be substituted by the above description for the temperature compensator 350 of the timing controller 300 shown in FIG. 4 or 5.

Then, the plurality of reference gamma voltages (RGV) may be generated according to the current limit gain value (CLG) calculated through the aforementioned process (210) for calculating the current limit gain value (CLG) (S211).

Then, the conversion data is converted into the data signal (Vdata) by the use of reference gamma voltages (RGV) (S212).

The organic light emitting device (OLED) for each pixel (P) emits light by the use of data signal (Vdata) (S213).

Thereafter, the aforementioned steps of S100 and S200 are repeated.

The process for controlling the current consumption of the display panel 110 according to the first embodiment of the present invention calculates the current limit gain value (CLG) on the basis of the input data (RGB) and the temperature data (TD); and controls the plurality of reference gamma voltages (RGV) by the use of calculated current limit gain value (CLG), whereby the current consumption of the display panel 110 is controlled to be lower than the preset current limit value.

Figure 14:
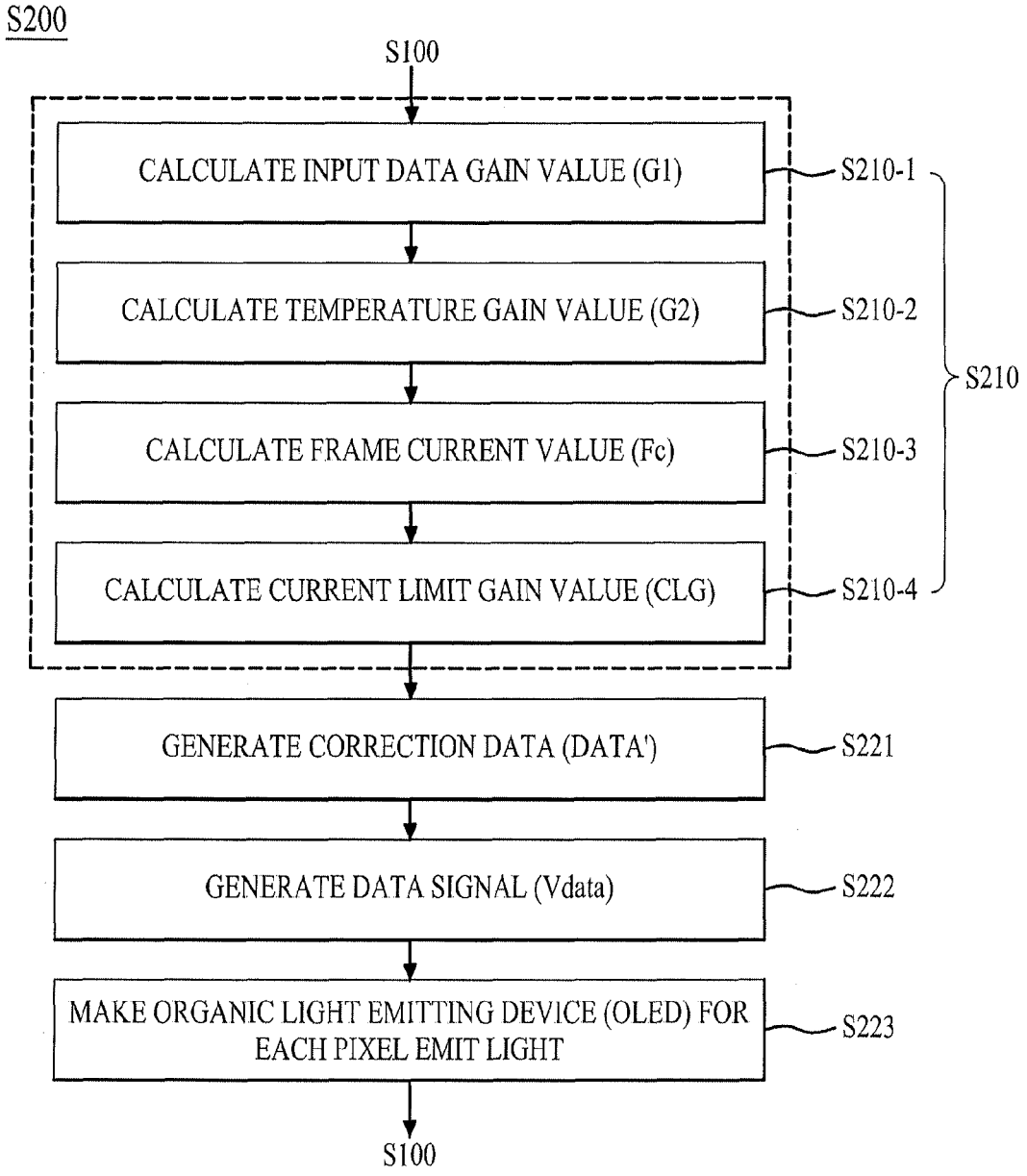
FIG. 14 is a flow chart illustrating a process for controlling current consumption of a display panel, shown in FIG. 12, according to the second embodiment of the present invention.

FIG. 14 is a flow chart illustrating the process for controlling the current consumption of the display panel, shown in FIG. 12, according to the second embodiment of the present invention.

First, the current limit gain value (CLG) is calculated for controlling the current consumption of the display panel 110 to be lower than the preset current limit value on the basis of the conversion data (DATA) converted from the input data (RGB) and the temperature data (TD) (S210). In more detail, as mentioned above, the process (S210) for calculating the current limit gain value (CLG) includes calculating the input data gain value (G1) on the basis of the input data (RGB) of one frame (S210-1); calculating the temperature gain value (G2) on the basis of the temperature data (TD) (S210-2); calculating the frame current value (Fc) from the conversion data (DATA) of one frame by the use of input data gain value (G1) and temperature gain value (G2) (S210-3); and generating the current limit gain value (CLG) on the basis of the frame current value (Fc) (S210-4). A detailed explanation about the process (S210) for calculating the current limit gain value (CLG) will be substituted by the above description for the temperature compensator 550 of the timing controller 500 shown in FIG. 7 or 8.

Then, the correction data (DATA') is generated by correcting the aligned data (R'G'B') obtained through conversion and alignment of the input data (RGB) according to the current limit gain value (CLG) calculated through the above process S210 (S221).

Then, the correction data (DATA') is converted into the data signal (Vdata) by the use of reference gamma voltages (S222).

Then, the organic light emitting device (OLED) for each pixel (P) emits light by the use of data signal (Vdata) (S223).

Thereafter, the aforementioned steps of S100 and S200 are repeated.

The process for controlling the current consumption of the display panel 110 according to the second embodiment of the present invention calculates the current limit gain value (CLG) on the basis of the input data (RGB) and the temperature data (TD); and controls the input data (RGB) by the use of calculated current limit gain value (CLG), whereby the current consumption of the display panel 110 is controlled to be lower than the preset current limit value.

Figure 15:
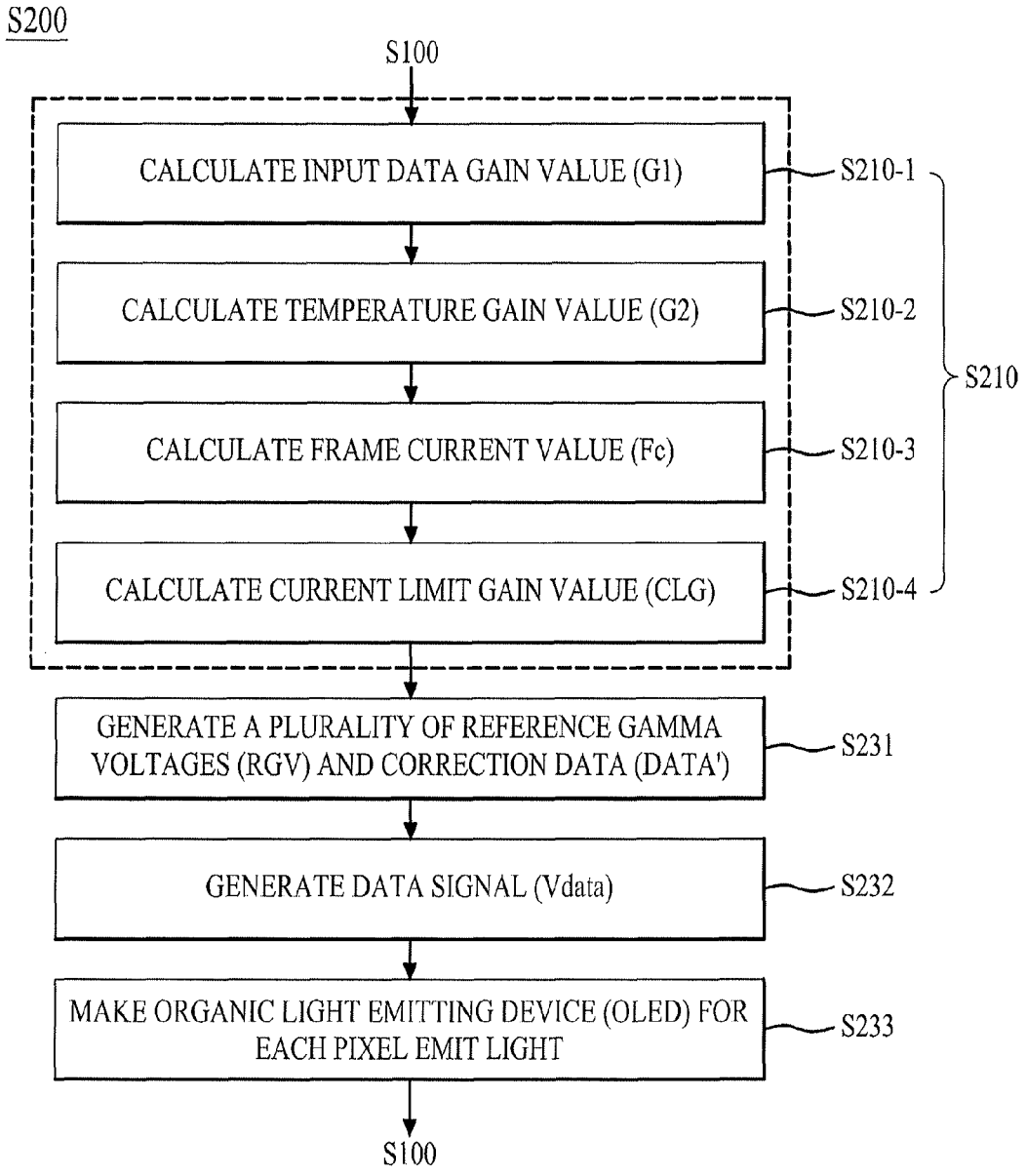
FIG. 15 is a flow chart illustrating a process for controlling current consumption of a display panel, shown in FIG. 12, according to the third embodiment of the present invention.

FIG. 15 is a flow chart illustrating the process for controlling the current consumption of the display panel, shown in FIG. 12, according to the third embodiment of the present invention.

First, the current limit gain value (CLG) is calculated for controlling the current consumption of the display panel 110 to be lower than the preset current limit value on the basis of the conversion data (DATA) converted from the input data (RGB) and the temperature data (TD) (S210). In more detail, as mentioned above, the process (S210) for calculating the current limit gain value (CLG) includes calculating the input data gain value (G1) on the basis of the input data (RGB) of one frame (S210-1); calculating the temperature gain value (G2) on the basis of the temperature data (TD) (S210-2); calculating the frame current value (Fc) from the conversion data (DATA) of one frame by the use of input data gain value (G1) and temperature gain value (G2) (S210-3); and generating the current limit gain value (CLG) on the basis of the frame current value (Fc) (S210-4). During the process S210-4 for generating the current limit gain value (CLG), the current limit gain value (CLG) is divided according to the preset proportion, to thereby generate the current limit gain value (CLG1) for gamma voltage and the current limit gain value (CLG2) for data. A detailed explanation about the process (S210) for calculating the current limit gain value (CLG) will be substituted by the above description for the temperature compensator 650 of the timing controller 600 shown in FIG. 10 or 11.

Then, according to the current limit gain value (CLG) calculated through the above process S210 for calculating the current limit gain value (CLG), the plurality of reference gamma voltages (RGV) are generated, and the correction data (DATA') is generated by correcting the aligned data (R'G'B') obtained through conversion and alignment of the input data (RGB), simultaneously (S231). That is, the plurality of reference gamma voltages (RGV) are generated according to the current limit gain value (CLG1) for gamma voltage, and the correction data (DATA') is generated according to the current limit gain value (CLG2) for data.

Then, the correction data (DATA') is converted into the data signal (Vdata) by the use of reference gamma voltages (S232).

Then, the organic light emitting device (OLED) for each pixel (P) emits light by the use of data signal (Vdata) (S233).

Thereafter, the aforementioned steps of S100 and S200 are repeated.

The process for controlling the current consumption of the display panel 110 according to the third embodiment of the present invention calculates the current limit gain value (CLG) on the basis of the input data (RGB) and the temperature data (TD); and simultaneously controls the input data (RGB) and the plurality of reference gamma voltages (RGV) by the use of calculated current limit gain value (CLG), whereby the current consumption of the display panel 110 is controlled to be lower than the preset current limit value.

Figure 16:
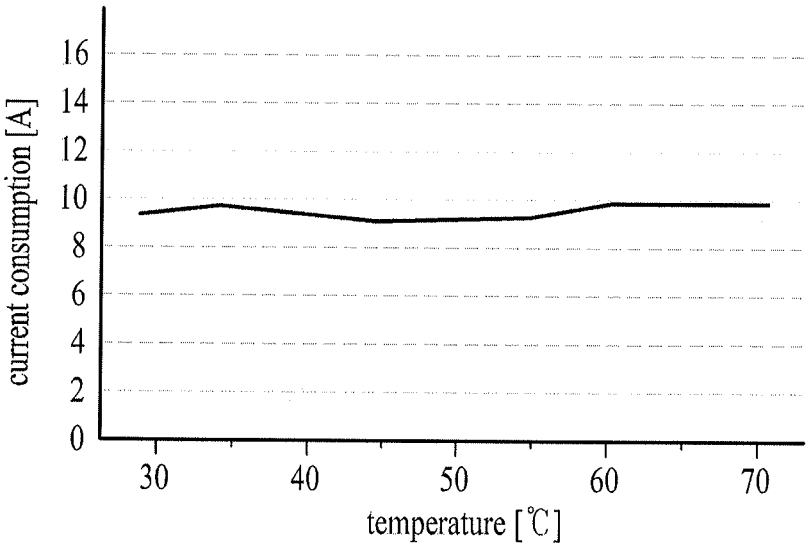
FIG. 16 is a graph illustrating current consumption of a display panel according to a surrounding (or environmental) temperature and/or a temperature of the display panel in the apparatus and method for driving the organic light emitting display device according to the embodiment of the present invention.

FIG. 16 is a graph illustrating the current consumption of the display panel according to the surrounding (or environmental) temperature and/or the temperature of the display panel in the apparatus and method for driving the organic light emitting display device according to the embodiment of the present invention.

As shown in FIG. 16, even though the surrounding (or environmental) temperature and/or the temperature of the display panel is increased, the apparatus and method for driving the organic light emitting display device according to the embodiment of the present invention control the current consumption of the display panel to be lower than the preset current limit value, for example. 10A.

Accordingly, the apparatus and method for driving the organic light emitting display device according to the embodiment of the present invention controls the current consumption of the display panel 110 to be lower than the current limit value according to the temperature of the display panel 110 or the surrounding temperature, so that it is possible to prevent shut-down of the power supplier, and further to improve reliability of apparatus (or product).

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for driving an organic light emitting display device comprising:

a display panel including a plurality of pixels provided with a plurality of light emitting devices which emit light according to a current;

a temperature sensing unit that generates temperature data by sensing a temperature of the display panel or surrounding temperature; and a panel driver that generates a frame current value of one frame by the use of input data and temperature data, generates a current limit gain value for controlling the current consumption of the display panel be lower than the preset current limit value based on the frame current value, and controls a data signal to be supplied to each pixel based on the current limit gain value.

2. The apparatus according to claim 1, wherein the panel driver converts the input data into conversion data; generates a plurality of reference gamma voltages that control the current consumption of the display panel to be lower than the preset current limit value on the basis of the current limit gain value; and converts the conversion data to the data signal by the use of reference gamma voltages so as to make the light emitting device emit light.

3. The apparatus according to claim 2, wherein the panel driver comprises:

a data driver which converts the conversion data into the data signal by the use of reference gamma voltages, and supplies the data signal to each pixel;

a scanning driver which supplies a scanning signal to each pixel; and a controller which controls each driving of the data driver and the scanning driver, generates the conversion data and the plurality of reference gamma voltages, and supplies the generated conversion data and the plurality of reference gamma voltages to the data driver, wherein the controller converts the input data into the conversion data, generates the current limit gain value on the basis of the temperature data and conversion data, and generates the plurality of reference gamma voltages by the use of current limit gain value.

4. The apparatus according to claim 3, wherein the controller includes a temperature compensating unit which calculates an input data gain value based on the input data of one frame, and a temperature gain value based on the temperature data; calculates the frame current value from the conversion data of one frame by the use of input data gain value and temperature gain value; and generates the current limit gain value based on the frame current value.

5. The apparatus according to claim 4, wherein the temperature compensating unit calculates a frame current gain value by dividing the input data gain value by the temperature gain value; and calculates the frame current value by reflecting the frame current gain value on the conversion data of one frame.

6. The apparatus according to claim 4, wherein the temperature compensating unit corrects the frame current value by reflecting the temperature gain value on the frame current value; and generates the current limit gain value on the basis of the corrected frame current value.

7. The apparatus according to claim 1, wherein the panel driver converts the input data into conversion data; generates correction data by correcting the conversion data so as to make the current consumption of the display panel be lower than the preset current limit value on the basis of the current limit gain value; converts the correction data into the data signal by a plurality of reference gamma voltages; and makes the light emitting device emit light.

8. The apparatus according to claim 7, wherein the panel driver comprises:

a data driver which converts the correction data into the data signal by the use of reference gamma voltages, and supplies the data signal to each pixel;

a scanning driver which supplies a scanning signal to each pixel; and a controller which controls each driving of the data driver and the scanning driver, generates the correction data and the plurality of reference gamma voltages, and supplies the generated correction data and the plurality of reference gamma voltages to the data driver, wherein the controller converts the input data into the conversion data, generates the current limit gain value on the basis of the temperature data and conversion data, and generates the correction data by correcting the conversion data by the use of current limit gain value.

9. The apparatus according to claim 8, wherein the controller includes a temperature compensating unit which calculates an input data gain value based on the input data of one frame, and a temperature gain value based on the temperature data; calculates the frame current value from the conversion data of one frame by the use of input data gain value and temperature gain value; and generates the current limit gain value based on the frame current value.

10. The apparatus according to claim 1, wherein the panel driver converts the input data into conversion data; simultaneously generates a plurality of reference gamma voltages and correction data by correcting the conversion data for controlling the current consumption of the display panel to be lower than the preset current limit value on the basis of the current limit gain value; converts the correction data to the data signal by the use of reference gamma voltages; and makes the light emitting device emit light.

11. The apparatus according to claim 10, wherein the panel driver comprises:

a data driver which converts the correction data into the data signal by the use of reference gamma voltages, and supplies the data signal to each pixel;

a scanning driver which supplies a scanning signal to each pixel; and a controller which controls each driving of the data driver and the scanning driver, generates the correction data and the plurality of reference gamma voltages, and supplies the generated correction data and the plurality of reference gamma voltages to the data driver, wherein the controller converts the input data into the conversion data, generates current limit gain value on the basis of the temperature data and conversion data, and generates the plurality of reference gamma voltages and the correction data by correcting the conversion data through the use of current limit gain value.

12. The apparatus according to claim 11, wherein the controller generates a current limit gain value for gamma voltage and a current limit gain value for data by dividing the current limit gain value according to a preset proportion; and generates the correction data by correcting the conversion data by the use of current limit gain value for data, and simultaneously generates the plurality of reference gamma voltages by the use of current limit gain value for gamma voltage.

13. A method for driving an organic light emitting display device comprising a display panel for displaying an image by making a light emitting device in each of pixels emit light by the use of current, comprising:

generating temperature data by sensing a temperature of the display panel or surrounding temperature;

generating a frame current value of one frame by the use of input data and temperature data;

generating a current limit gain value for controlling the current consumption of the display panel be lower than the preset current limit value based on the frame current value; and controlling a data signal to be supplied to each pixel based on the current limit gain value.

14. The method according to claim 13, wherein the process for controlling the data signal to be supplied to each pixel comprises:

converting the input data into conversion data;

generating a plurality of reference gamma voltages by the use of current limit gain value; and converting the conversion data into the data signal by the use of reference gamma voltages, and supplying the data signal to each pixel so as to make the light emitting device emit light.

15. The method according to claim 14, wherein the process for generating the current limit gain value comprises:

calculating an input data gain value based on the input data of one frame, and a temperature gain value based on the temperature data;

calculating the frame current value from the conversion data of one frame by the use of input data gain value and temperature gain value; and generating the current limit gain value based on the frame current value.

16. The method according to claim 15, wherein the process for calculating the frame current value comprises:

calculating a frame current gain value by dividing the input data gain value through the temperature gain value; and calculating the frame current value by reflecting the frame current gain value on the conversion data of one frame.

17. The method according to claim 15, wherein the process for generating the current limit gain value comprises correcting the frame current value by reflecting the temperature gain value on the frame current value, wherein the current limit gain value is generated according to the corrected frame current value.

18. The method according to claim 13, wherein the process for controlling the data signal to be supplied to each pixel comprises:

converting the input data into conversion data;

generating correction data by correcting the conversion data through the use of current limit gain value; and converting the correction data into the data signal by a plurality of reference gamma voltages, and supplying the data signal to each pixel so as to make the light emitting device emit light.

19. The method according to claim 13, wherein the process for controlling the data signal to be supplied to each pixel comprises:

converting the input data into conversion data;

generating correction data by correcting the conversion data through the use of current limit gain value and simultaneously generating a plurality of reference gamma voltages by the use of current limit gain value; and converting the correction data into the data signal by the use of reference gamma voltages, and supplying the data signal to each pixel so as to make the light emitting device emit light.

20. The method according to claim 19, wherein the process for generating the current limit gain value further comprises generating a current limit gain value for gamma voltage and a current limit gain value for data by dividing the current limit gain value according to a preset proportion, and wherein the process for generating the correction data by correcting the conversion data through the use of current limit gain value and simultaneously generating the plurality of reference gamma voltages by the use of current limit gain value comprises generating the correction data by correcting the conversion data through the use of current limit gain value for data, and generating the plurality of reference gamma voltages by the use of current limit gain value for gamma voltage.

* * * * *